US007638699B2

(12) United States Patent
Buettgen

(10) Patent No.: US 7,638,699 B2
(45) Date of Patent: Dec. 29, 2009

(54) MUSICAL INSTRUMENT SUPPORT BRACE

(76) Inventor: John J. Buettgen, 948 Grand Ave., Schofield, WI (US) 54476

( * ) Notice: Subject to any disclaimer, the term of this patent is extended or adjusted under 35 U.S.C. 154(b) by 0 days.

(21) Appl. No.: 12/128,458

(22) Filed: May 28, 2008

(65) Prior Publication Data

US 2009/0293702 A1 Dec. 3, 2009

(51) Int. Cl.
*G10D 7/10* (2006.01)

(52) U.S. Cl. ..... 84/387 A

(58) Field of Classification Search ..... 84/387 A, 84/387 R, 330

See application file for complete search history.

(56) References Cited

U.S. PATENT DOCUMENTS 1,255,766 A 2/1918 Martens
3,123,832 A * 3/1964 Kubik ..... 2/161.1
3,834,268 A 9/1974 McCracken
3,937,116 A 2/1976 Ramirez
4,138,108 A 2/1979 Robinson
4,977,809 A 12/1990 Staley, Jr.
5,894,098 A 4/1999 Hsieh
6,279,163 B1 * 8/2001 Hale et al. ..... 2/160
6,504,087 B2 1/2003 Shulman

OTHER PUBLICATIONS

Rest Bar Installation Gallery, web page printout from Greenhoe Trombones and Components http://www.greenhoe.com/ProdInfo/Includes/RestBarInstallGallery.htm (c) 2000-2004 Greenhoe Inc.

* cited by examiner

*Primary Examiner*—Kimberly R Lockett
(74) *Attorney, Agent, or Firm*—Stiennon & Stiennon

(57) ABSTRACT

A support brace for a musical instrument such as a base trombone has a flexible band which is configured to be wrapped around a user's wrist and hand. The band has an upwardly extending first pocket which contains a first reinforcement member. Straps extend from the band and employ hook and loop fastener material to adjustably retain the band on the user's wrist and hand. An elliptical support knob extends outwardly from the band and is configured to receive and support a horizontal tube portion of the musical instrument. A first fastener with a head extends through the first reinforcement member and the band and is secured to the support knob, thereby joining the knob to the reinforcement member so that forces applied to the support knob are carried to the first reinforcement member. The instrument height can be adjusted by rotating and securing in place the elliptical support knob.

10 Claims, 2 Drawing Sheets

MUSICAL INSTRUMENT SUPPORT BRACE

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to support braces in general, and more particularly to hand-worn braces which facilitate the use of particular implements.

Some musical instruments, such as the trombone and the base trombone, require the performer to carry a portion of the instrument's weight on one hand, while the other hand is left free to manipulate the instrument. Especially with the base trombone, extended support of the instrument can place a strain on the player's wrist, and can lead to fatigue which in turn can compromise the quality of the performance.

A number of attachments to a conventional trombone have been developed to allow the trombone tubing to be more readily gripped or to rest more comfortably on the player's hand. Yet these devices are attached to the trombone itself, and cannot give support to the player's wrist, which must be free to readily separate from the instrument What is needed is an aid to players of heavy instruments which gives additional support to the weight of the instrument while reducing the performer's wrist fatigue.

SUMMARY OF THE INVENTION

The musical instrument support brace of this invention has a flexible band which is configured to be wrapped around a user's wrist and hard. The band has an upwardly extending first pocket which contains a first reinforcement member. Straps extend from the band and employ hook and loop fastener material to adjustably retain the band on the uses wrist and hand. An elliptical support knob extends outwardly from the band and is configured to receive and support a horizontal tube portion of a musical instrument such as a trombone or a base trombone. A first fastener with a head extends through the first reinforcement member and support the band and is secured to the support knob, thereby joining the knob to the reinforcement member so that forces applied to the support knob are carried to the first reinforcement member. The instrument height can be adjusted by rotating and securing in place the elliptical support knob.

It is an object of the present invention to provide a musical instrument support brace which is mounted to a performer's hand without modification to the instrument.

It is another object of the present invention to provide a musical instrument support brace which carries the loads of the instrument's weight to the performer's wrist while reducing the intensity with which the performer must grip the instrument.

Further objects, features and advantages of the invention will be apparent from the following detailed description when taken in conjunction with the accompanying drawings.

DESCRIPTION OF THE PREFERRED EMBODIMENTS

Figure 1:
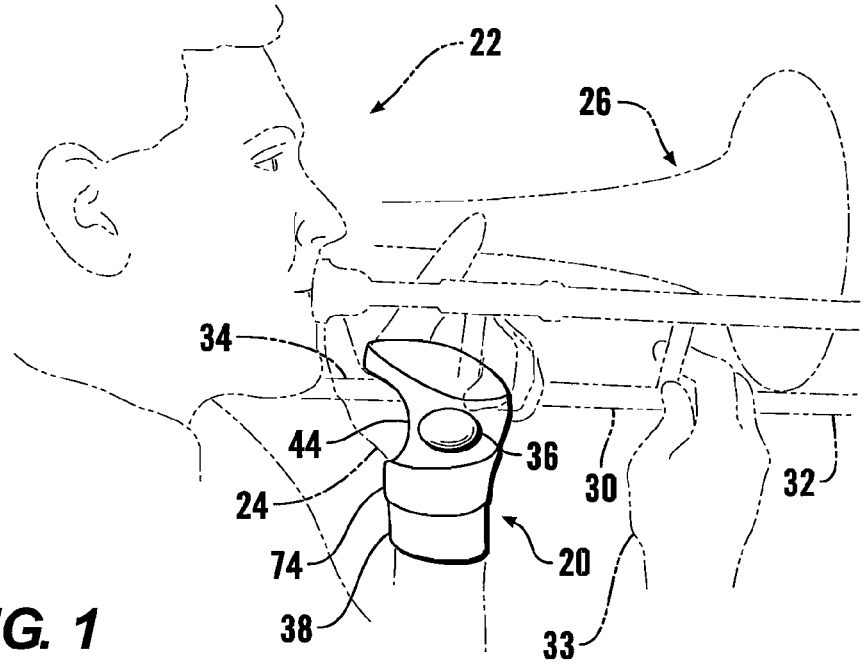
FIG. 1 is a side perspective view of the support brace of this invention worn by a trombonist.
Figure 2:
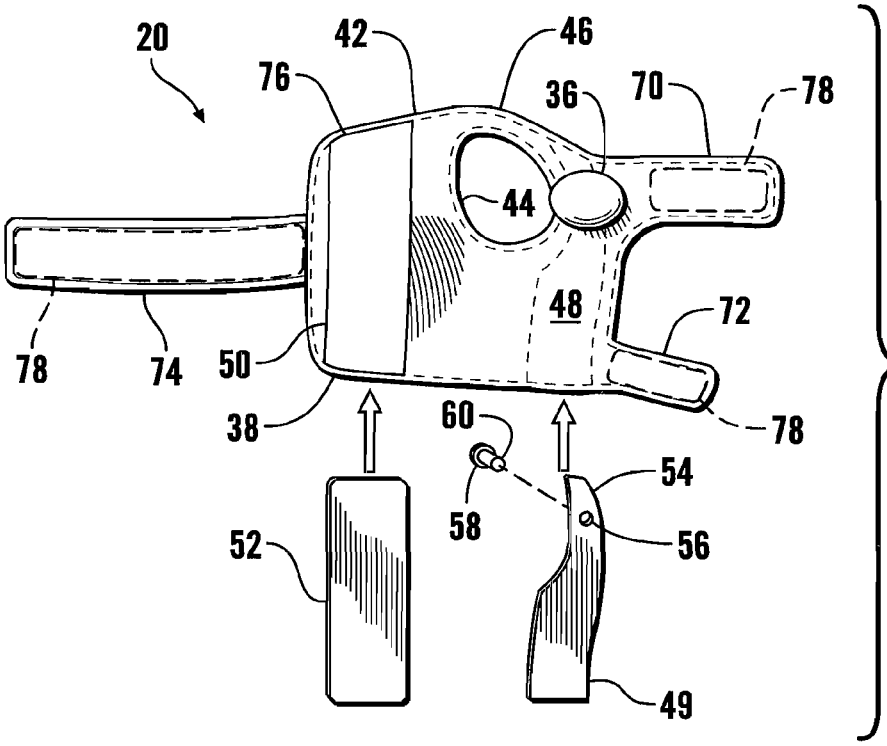
FIG. 2 is a side exploded view of the support brace of FIG. 1.
Figure 3:
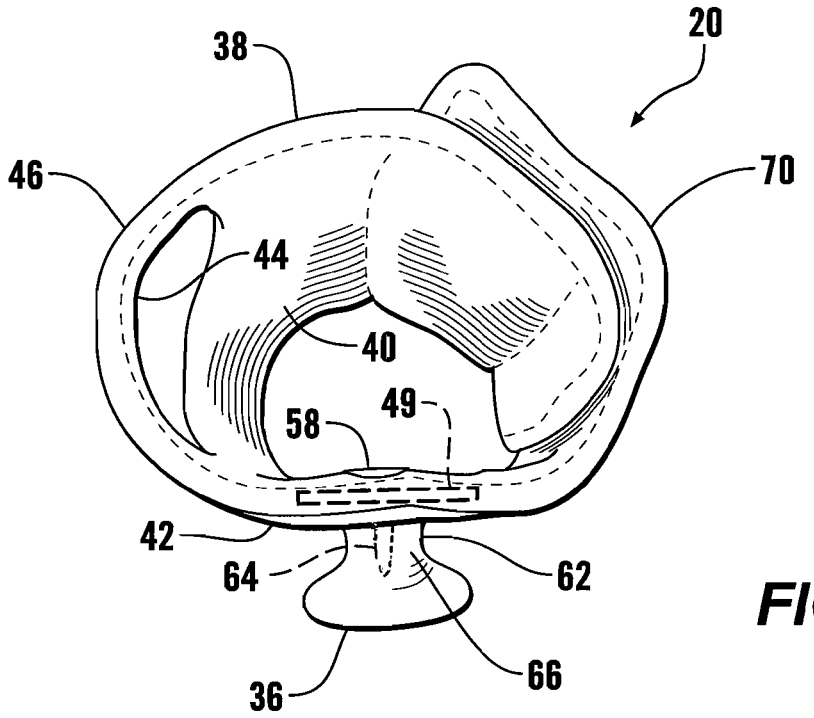
FIG. 3 is a top perspective view of the support brace of FIG. 2.

Referring more particularly to FIGS. 1-3, wherein like numbers refer to similar parts, a musical instrument support brace 20 is shown in FIG. 1. The support brace 20 may be worn by a performer 22 on a first hand 24, for example on the left hand. The support brace 20 may incorporate elements of a conventional wrist brace, such as the one shown in U.S. Pat. No. 4,138,108, the disclosure of which is incorporated by reference herein. The support brace 20 facilitates the performer's musical expression while operating a musical instrument 26 such as a base trombone. As shown in phantom view in FIG. 1, the base trombone has an inner slide 30 comprised of cylindrical tubing which is gripped by the first hand of the performer, and an outer slide 32 which is operated by the performer using the other hand 33. The outer slide 32 must be freely adjustable, and is rapidly moved from position to position to allow the different pitched tones of the instrument to be produced. Substantially all the weight of the instrument is thus primarily carried by the performer's first hand 24. The instrument 26 inner slide has a horizontal section 34 of tubing which engages with a support knob 36 which extends from the brace 20.

As shown in FIG. 2, the support brace 20 has a flexible band defined by a main body 38 comprised of a flexible fabric assembly of an inner layer 40 worn adjacent the performer's first hand 24, and an outer layer 42 which overlies the inner layer 40. The main body 38 has a thumb hole 44 centrally positioned and which extends through both layers of fabric. The thumb hole 44 is located beneath a narrow strap 46. Two downwardly opening pockets are defined between the inner layer 40 and the outer layer 42: a first pocket 48 which receives a first reinforcement member 49, and a second pocket 50 which receives a second reinforcement member 52. Both reinforcement members are thin metal plates, preferably aluminum.

The first reinforcement member 49 is a vertically extending plate which is about 7 cm across at its base, 6 cm across at a middle height, and tapering to about 1 cm across at an upper segment 54 where it extends upwardly alongside the thumb hole 44. The first reinforcement member 49 may be bowed along the upper segment 54 as it extends along the palm of the wearer's hand. A fastener hole 56 extends through the first reinforcement member upper segment 54. A fastener 58 such as a flat-head wood screw extends through the inner layer of material 40, through the fastener hole 56 in the first reinforcement member 49 and through the outer layer of material such that a threaded shaft 60 of the first fastener 58 projects outwardly and is received in a opening 64 in the 62 of the support knob 36, as shown in FIG. 3.

The first fastener 58 adjustably fastens the support knob to the first reinforcement member 49. The support knob 36 head protrudes outwardly from the narrower shaft 62, such that the supported horizontal section 34 of tubing may be engaged between the knob head and the main body 38 of the brace. If it is desired to adjust the height at which the horizontal section 34 is supported, the first fastener 58 is loosened, the knob rotated until in the desired orientation, and then the first fastener is tightened to again hold the knob in place.

The support brace 20 main body 38 has an upper strap 70 and a lower strap 72 which extend sidewardly to one side, and a middle strap 74 which exends sidewardly to the opposite side of the body. A generally rectangular patch 76 of a first part of a two-part hook-and-loop fastener material such as VELCRO® fastener manufactured by Velcro Industries B.V. is sewn to the other layer of material across the thumb hole from the support knob. Patches 78 of the other part of the hook-and-loop fastener material are secured to the upper strap 70, the middle strap 74, and the lower strap 72 facing inwardly. By engaging the straps 70, 72, 74 with the patch 76, the support brace 20 may be readily configured to a variety of hand shapes and sizes.

Figure 4:
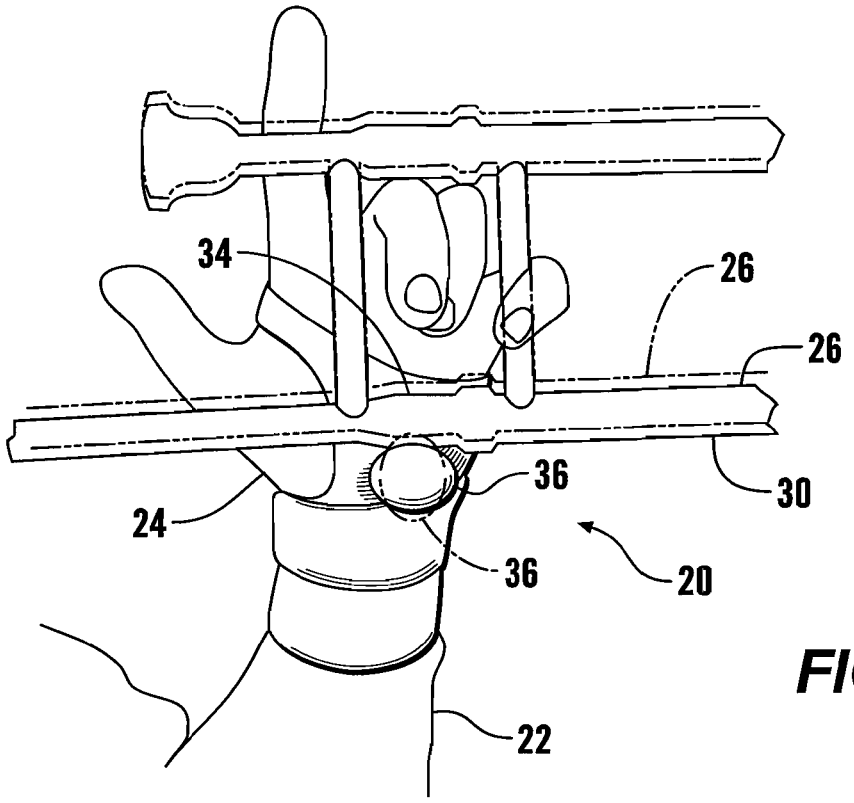
FIG. 4 is a side perspective view of the support brace of FIG. 1, shown in alternate configurations; in solid line as configured to support a musical instrument at a first elevation, and in phantom lines as configured to support the musical instrument at a higher elevation.

As best shown in FIG. 4, the support knob 36 has a first dimension extending in a first direction which is perpendicular to the shaft 60 of the first fastener 58, and a second dimension extending in a second direction which is perpendicular to the shaft and to the first direction. The second dimension is greater than the first dimension. Thus the support knob 36 may be rotatably positioned so that the distance between the supported portion of the musical instrument 26 on the support knob and the shaft is adjusted. Although a number of knob profiles may be employed, in one form it may have an elliptical perimeter. This adjustment allows the individual player to set the instrument at a desired height over a range determined by the difference between the second dimension and the first dimension.

In use the musical instrument support brace 20 provides a convenient performance aid which is completely independent of the particular instrument. The support brace 20 does not require significant retaining of the performer, who continues to operate the instrument in the same fashion as without the support, but is simply provided with some level of relief from fatigue, as the loads are carried from the support knob to the player's wrist.

Should it become necessary to wash the support brace from time to time, the support knob and the first fastener can be removed from the first reinforcement member, and the first and second reinforcement members can be removed from the brace and the main body and attached straps can be washed by machine or in any other conventional fashion.

When adjustable height is not required, the musical instrument support brace may be formed such that the knob is not rotatably adjustable. In such a case the knob may be circular, or have a profile particular configured to engage the tubing of the instrument.

It is understood that the invention is not limited to the particular construction and arrangement of parts herein illustrated and described, but embraces all such modified forms thereof as come within the scope of the following claims.

I claim:

1. A musical instrument support brace, comprising:

a flexible band which is configured to be wrapped around a user's hand, the band having fasteners thereon for securing the band to the user's hand;

a first reinforcement member connected to the flexible band and extending upwardly; and a support knob extending outwardly from the band, the support knob having a head which protrudes outwardly from a narrower shaft, the knob being configured to receive a portion of the musical instrument thereon in supporting relation, with the portion engaged between the knob head and the flexible band, the support knob being secured to the first reinforcement member such that forces applied to the support knob are carried to the first reinforcement member.

2. A musical instrument support brace, comprising:

a flexible band which is configured to be wrapped around a user's band, the band having fasteners thereon for securing the band to the user's hand;

a first reinforcement member connected to the flexible band and extending upwardly;

a support knob extending outwardly from the band, the knob being configured to receive a portion of the musical instrument thereon in supporting relation, the support knob being secured to the first reinforcement member such that forces applied to the support knob are carried to the first reinforcement member; and a first fastener which extends through the first reinforcement member and which has a shaft which extends outwardly from the first reinforcement member.

3. The musical instrument support brace of claim 2 wherein the support knob has a first dimension extending in a first direction which is perpendicular to the shaft and a second dimension extending in a second direction which is perpendicular to the shaft and to the first direction, the second dimension being greater than the first dimension, the support knob being rotatably positionable on the shaft by releasing the first fastener, rotating the support knob, and securing again the first fastener with the support knob in an altered position, such that the distance between a portion of the musical instrument supported on the support knob and the shaft is adjustable by rotating the support knob on the shaft.

4. The musical instrument support brace of claim 2 wherein the profile of the support knob defines an ellipse.

5. A musical instrument support brace, comprising:

a flexible band which is configured to be wrapped around a user's band, the band having fasteners thereon for securing the band to the user's hand;

a first reinforcement member connected to the flexible band and extending upwardly; and a support knob extending outwardly from the band, the knob being configured to receive a portion of the musical instrument thereon in supporting relation, the support knob being secured to the first reinforcement member such that forces applied to the support knob are carried to the first reinforcement member, wherein a first pocket is defined between an inner layer of material and an outer layer of material, and the first reinforcement member extends within the first pocket, and wherein the knob is secured to the first reinforcement member by a screw having a head on a shaft, the head being positioned inwardly of the inner layer of material, such that the shaft extends through an opening in the first reinforcement member into the support knob.

6. A musical instrument support brace, comprising:

a flexible band which is configured to be wrapped around a user's wrist and hand, the band having portions defining an upwardly extending first pocket;

a first reinforcement member extending upwardly within the first pocket;

at least one fastening element which extends from the band and which is adjustable attachable to a portion of the band to retain the band on the user's wrist and hand;

a support knob extending outwardly from the band, the knob being configured to receive a portion of the musical instrument thereon in supporting relation; and a first fastener which secures the support knob to the first reinforcement member, such that forces applied to the support knob are carried to the first reinforcement member, wherein the support knob has a first dimension extending in a first direction which is perpendicular to the shaft and a second dimension extending in a second direction which is perpendicular to the shaft and to the first direction, the second dimension being greater than the first dimension, the support knob being rotatably positionable on the shaft by releasing the first fastener, rotating the support knob, and securing again the first fastener with the support knob in an altered position, such that the distance between a portion of the musical instrument supported on the support knob and the shaft is adjustable by rotating the support knob on the shaft.

7. The musical instrument support brace of claim 6 wherein the profile of the support knob defines an ellipse.

8. A musical instrument support brace, comprising:

a flexible band which is configured to be wrapped around a user's wrist and hand, the band having portions defining an upwardly extending first pocket;

a first reinforcement member extending upwardly within the first pocket;

at least one fastening element which extends from the band and which is adjustably attachable to a portion of the band to retain the band on the user's wrist and hand;

a support knob extending outwardly from the band, the knob being configured to receive a portion of the musical instrument thereon in supporting relation; and a first fastener which secures the support knob to the first reinforcement member, such that forces applied to the support knob are carried to the first reinforcement member, wherein the first pocket is defined between an inner layer of material and an outer layer of material, and wherein the first fastener is a screw having a head on the shaft, the head being positioned inwardly of the inner layer of material, such that the shaft extends through an opening in the first reinforcement member into the support knob.

9. A musical instrument support brace, comprising:

a flexible band which is configured to be wrapped around and secured to a user's hand;

a first fastener which extends through the band and which has a shaft;

a support knob which projects from the band and which is adjustably fastened to the first fastener shaft, the knob being configured to receive a portion of the musical instrument thereon in supporting relation, to transfer loads to the user's hand, wherein the support knob has a first dimension extending in a first direction which is perpendicular to the shaft and a second dimension extending in a second direction which is perpendicular to the shaft and to the first direction, the second dimension being greater than the first dimension, the support knob being rotatably positionable on the shaft in variable positions such that the distance between a portion of the musical instrument supported on the support knob and the shaft is adjustable by rotating the support knob on the shaft.

10. The musical instrument support brace of claim 9 wherein the profile of the support knob defines an ellipse.

* * * * *